United States Patent [19]

Sears

[11] Patent Number: 4,977,678

[45] Date of Patent: Dec. 18, 1990

[54] ARCHERY SIGHT

[76] Inventor: Benny Sears, Rte. 2, Cleveland, Ga. 30528

[21] Appl. No.: 372,423

[22] Filed: Jun. 27, 1989

[51] Int. Cl.[5] ..... F41G 1/40

[52] U.S. Cl. ..... 33/265

[58] Field of Search ..... 33/265, 233, 252, 261; 124/87

[56] References Cited

U.S. PATENT DOCUMENTS

| | | | |
|---|---|---|---|
| 398,315 | 2/1889 | Cutler | 33/261 |
| 4,146,009 | 3/1979 | Adams . | |
| 4,159,575 | 7/1979 | Kalmbach | 33/265 |
| 4,215,484 | 8/1980 | Lauffenburger | 33/265 |
| 4,385,618 | 5/1983 | Nishioka . | |
| 4,446,844 | 5/1984 | Nishioka . | |
| 4,462,163 | 7/1984 | Tentler et al. | 33/265 |
| 4,597,211 | 7/1980 | Miles | 33/261 X |
| 4,693,229 | 9/1987 | Nishioka . | |
| 4,696,281 | 9/1987 | Nishioka . | |

OTHER PUBLICATIONS

Bowhunters Discount Warehouse Catalog: Summer 1988 Edition, pp. 29 through 33.

*Primary Examiner*—Harry N. Haroian
*Attorney, Agent, or Firm*—Thomas & Kerr

[57] ABSTRACT

An archery sight for use with a bow has one or more adjustable beaded sighting pins extending vertically, parallel to the bow frame. A notched sighting plate is mounted remote from the pins with the notches aligned with the pins in the sighting direction.

5 Claims, 2 Drawing Sheets

ARCHERY SIGHT

TECHNICAL FIELD

This invention relates to sighting devices for use with an archery bow, and, more particularly, to quick aiming sights for use in archery hunting.

BACKGROUND OF THE INVENTION

An archery sight for aiming the arrow or projectile is a virtual necessity for both competition shooting and for hunting. In general, such a sight consists of a plurality of horizontal, transversely extending pins in a vertical array, with the array affixed to the frame of the bow above the hand grip and arrow shelf. The free ends of the pins are beaded, in the manner of a rifle sight, to facilitate aiming. A peep-sight is mounted to the bowstring at the operator's eye level, and aiming is accomplished by aligning one of the beads with the target through the peep-sight. The horizontal pins are adjustable, both horizontally and vertically, for windage and elevation, respectively. Each of the pins can be set vertically for a specific range prior to actual use in hunting, for example, and in practice, the particular pin used will depend upon the archer's estimate of target range. Windage, i.e., horizontal adjustments of the pins generally must be done in the field, and where, for example, four pins set at different elevations or ranges are used, windage adjustment presents a delay where often speed is of the essence.

Where the peep-sight is affixed to the bowstring, as is generally the case, proper and consistent aiming requires that the bowstring be drawn in an absolutely consistent manner, with the same draw force and same finger location on the bowstring. These requirements are quite difficult to meet in hunting conditions.

In dim light it is difficult to sight through a peep hole at the appropriate bead and target. Efforts to alleviate the problems presented by dim light principally have been directed to providing some form of illumination for the bead, a solution that has not proven to be completely satisfactory for a number of reasons, among which are the difficulty in sighting on an illuminated bead through a peep-sight at an unilluminated target, and dependence upon an artificial source of illumination including a battery, which can fail at the most unpropitious moments.

SUMMARY OF THE INVENTION

The present invention overcomes the aforementioned problems of the prior art in a first illustrative embodiment thereof wherein a longitudinal sight frame having front and rear end portions is adapted to be mounted to the frame of the bow in such a manner as to define a sighting direction. A front bracket is mounted to the sight frame at the front end portion and extends transversely thereto and to the sighting direction, and a rear bracket is mounted to the sight frame at the rear end portion thereof and extends parallel to the front bracket in the same direction. At least one sighting pin having a top end is mounted to the front bracket and extends vertically, parallel to the bow frame when the sight frame is mounted to the bow frame and normal to the sighting direction, and a notched sighting member is mounted to the rear bracket with the notch aligned with the top end of the sighting pin.

The sighting pin or pins are adjustable both laterally and vertically relative to the sight frame and the front bracket respectively, and a sight guard is mounted to the sight frame and substantially surrounds the sighting pins to protect them and their settings.

In another embodiment of the invention, for use with an overdraw attachment, the sight frame and front bracket are mounted to the bow frame, and the rear bracket is mounted to the rear of the overdraw attachment.

The various features and advantages of the present invention will be readily apparent from the following detailed description, read in conjunction with the accompanying drawing, in which:

DETAILED DESCRIPTION

Figure 1:
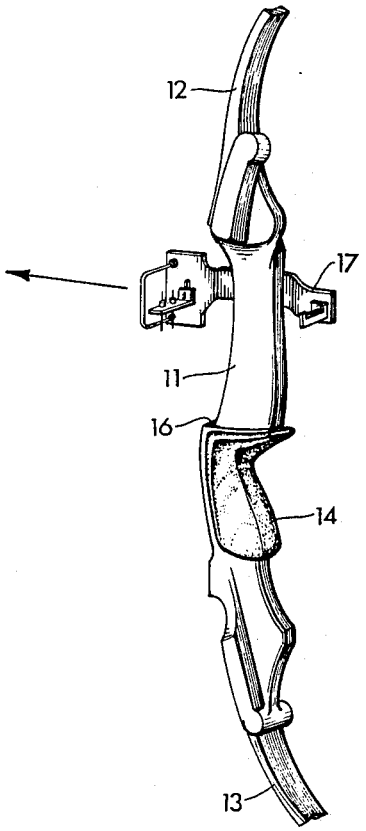
FIG. 1 is a perspective view of a portion of a bow showing the sight attachment of the present invention mounted thereon.

In FIG. 1 there is shown a bow frame 11 having upper and lower limbs 12 and 13 respectively, a hand grip 14 and an arrow shelf 16. Mounted to the bow frame 11 in a position above the hand grip 14 and arrow shelf 16, approximately level with the archer's eye, and defining a sighting direction as shown by the arrow, is a sighting attachment 17 embodying the principles of the present invention. For simplicity, the bowstring, which is connected between the free or distal ends of limbs 12 and 13, has not been shown.

Figure 2:
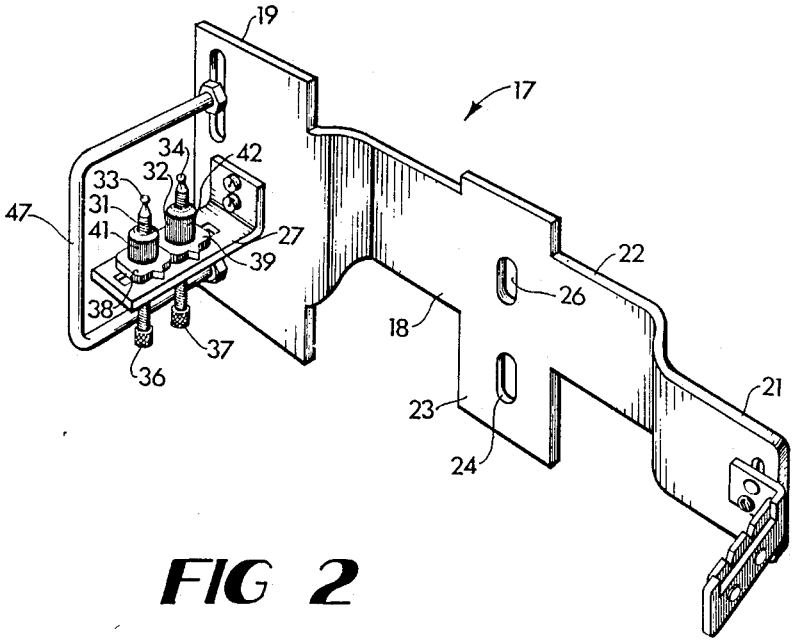
FIG. 2 is a perspective view of the sight of the present invention for mounting on a bow.
Figure 3:
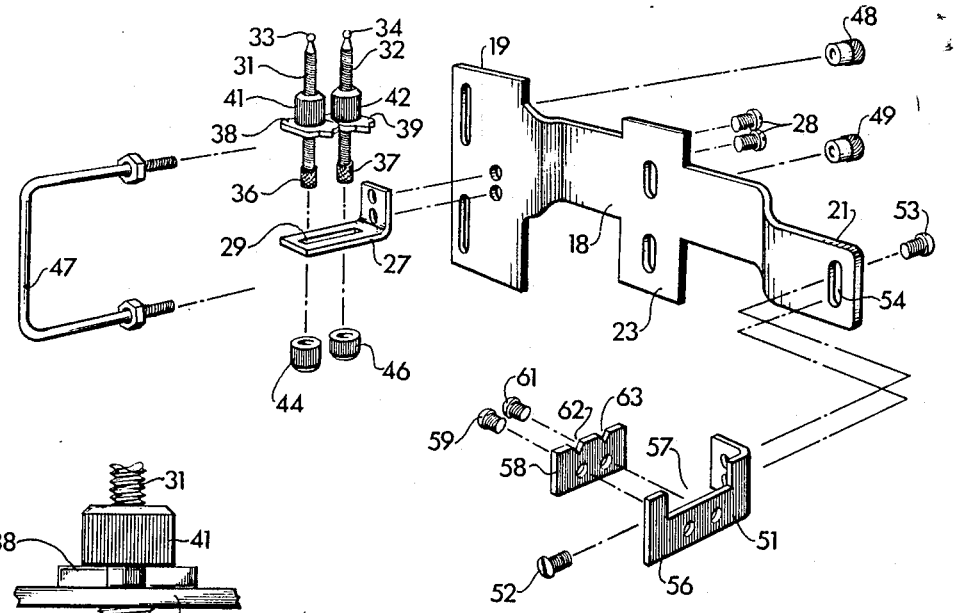
FIG. 3 is an exploded perspective view of the sight of FIG. 2.

FIGS. 2 and 3 depict the sighting attachment 17 in detail. Attachment 17 comprises a longitudinal sight frame 18 having a front end portion 19 and a rear end portion 21, with a central portion 22 joining the front and rear portions 19 and 21 and lying in a plane offset from the planes of portions 19 and 21 as shown. Portions 19 and 21 are preferably, although not necessarily, coplanar. Central portion 22 has a downwardly extending tang 23 having a slot 24 therein which is aligned with a slot 26 in portion 22 and mounting bolts, not shown, pass through slots 24 and 26 for mounting attachment 17 to frame 11, and afford a range of vertical adjustment of attachment 17 to accommodate the individual archer.

Figure 3A:
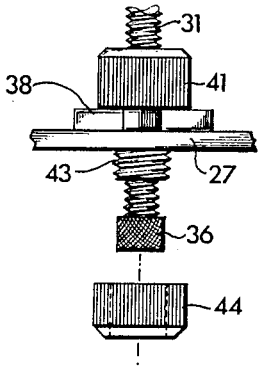
FIG. 3A is a partial elevation detail view showing the manner in which a sighting pin is mounted to the front bracket.

As best seen in FIG. 3, an L-shaped front bracket 27 is mounted to the front end portion 19 of frame 18 by suitable means such as bolts 28, 28. Bracket 27 extends normal to and out from portion 19, and, where attachment 17 is mounted on bow frame 11, transversely to the sighting direction. The normally extending leg of front bracket 27 has a longitudinal slot 29 therein for receiving first and second threaded sighting pins 31, 31 respectively, which pass therethrough. The top ends of pins 31 and 32 terminate in sighting beads 33 and 34, and the bottom ends terminate in knurled adjusting knobs 36 and 37. First and second indicator plates 38 and 39, through which pins 31 and 32 pass, rest on top of the leg of bracket 27 and are held in place by knurled nuts 41 and 42 threaded to pins 31 and 32 respectively. As best seen in FIG. 3A, nuts 41 and 42, only nut 41 being shown in FIG. 3A, each have a threaded lower portion 43 which passes through slot 29. Knurled nuts 44 and 46 having thread bores of a diameter sufficient to allow knurled knobs 36 and 37 to pass therethrough are screwed onto threaded portions 43 to hold the entire pin assembly in place, while leaving pins 31 and 32 free to turn in nuts 41 and 42 for any necessary adjustments. A sight or pin guard 47 which may take any of a number of forms, that shown here being a U-shaped rod, is bolted to portion 19 by means of nuts 48 and 49. Guard 47 protects pins 31 and 32 and their settings from being accidentally disturbed, and further protects against accidental snagging of the pins in heavy brush.

A rear L-shaped bracket 51 is mounted to rear end portions 21 by suitable means, such as bolts 52 and 53 passing through a slot 54 in end portion 21. The long leg 56 of bracket 51 extends outwardly from and normal to end portion 21, parallel to bracket 27, and across the line of sight when frame 17 is mounted on the bow. Leg 56 has a cut out portion 57 on its top edge over which a sighting plate 58 is mounted, as by bolts 59 and 61. Plate 58 has first and second notches 62 and 63 in its top edge which align with the top end beads 33 and 34 of pins 31 and 32, as best seen in FIG. 4.

Figure 4:
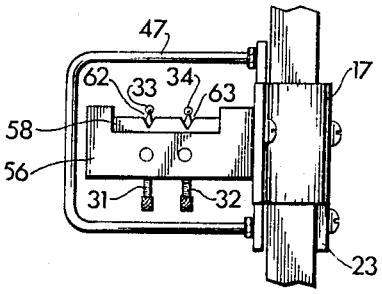
FIG. 4 is an elevation view of the sight attachment of the present invention as mounted on a bow and view from the archer's position.

The assembled sight is shown mounted on a bow in FIG. 4, as viewed from the archer's position. Windage corrections can be made by moving either or both of the pins 31 and 32 laterally, and range or elevation corrections can be made by moving them vertically. In addition, windage corrections can be had by sighting through either notch 62 or 63 at one of the pins, without the necessity of moving either pin laterally.

Figure 5:
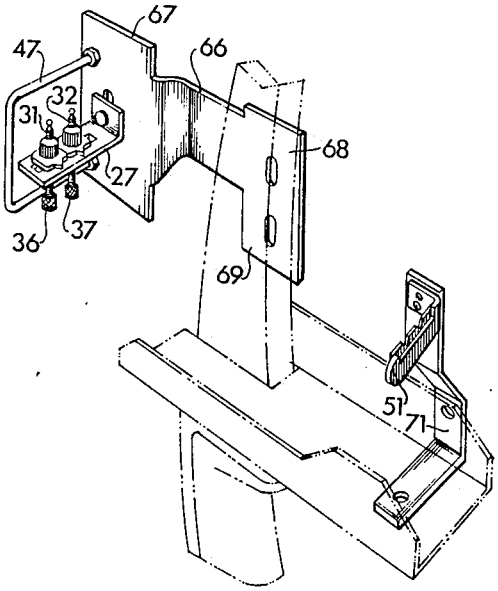
FIG. 5 is a perspective view of a sight for use with an overdraw attachment and which embodies the principles of the present invention.

In FIG. 5 there is shown a modification of the sight of FIGS. 1 through 4 for use with a bow having an overdraw attachment, which has been shown in dashed lines. In the arrangement of FIG. 5, the front and rear brackets 27 and 51 are the same as in FIGS. 1 through 4, and will not be described further. Front bracket 27 is mounted to a sight frame 66 on a front portion 67 thereof, and frame 66 is mountable to the bow by means of a rear portion 68 having a slotted tang 69. Rear bracket 51 is mounted to the rear end of the overdraw attachment by means of a mounting bracket 71 and aligned with the front sight assembly as shown, for example, in FIG. 4.

It can be seen that the notch and bead arrangement of the present invention is less vulnerable to sighting problems resulting from dim light than is a peep-sight arrangement. Further, adjustment of the pins for both range and windage can be accomplished expeditiously in the field, thus making the sight readily adaptable to changing conditions. In addition, it is not always necessary to adjust the sight for windage inasmuch as the combination of two beads and two sighting notches constitutes a built-in windage compensator.

The numerous features and advantages of the present invention have been shown in first and second illustrative embodiments thereof. Various changes or modifications may occur to workers in the art without departure from the spirit and scope of the invention.

I claim:

1. For use with a bow having a frame, upper and lower limbs, a bowstring connected between the ends of said limbs and a hand grip, a sighting attachment comprising:

a longitudinal sight frame member having front and rear end portions adapted to be mounted to the bow frame to define a sighting direction;

a front bracket mounted to said sight frame member at said front end portion thereof and extending normal thereto and to said sighting direction.

a rear bracket mounted to said sight frame member at said rear end portion thereof and extending transversely thereto parallel to said front bracket, at least two sighting pins each having a top end and being mounted to said front bracket to extend normal to said bracket and to said sighting direction, said sighting pins being oriented generally vertically when said sighting attachment is mounted to the bow frame and the bow frame is oriented vertically for use.

a sighting member having an upper edge and at least two notches in said upper edge, said sighting member being mounted to said rear bracket; and means for selectively and independently adjusting the longitudinal positions of said sighting pins along said front bracket and for selectively and independently adjusting the lateral positions of said sighting pins relative to said front bracket, with the longitudinal adjustment of each of said sighting pins being independent of the lateral adjustment thereof.

2. A sighting attachment as claimed in claim 1 wherein said means for adjusting the longitudinal positions of said sighting pins comprises a slot formed in said front bracket through which said sighting pins pass, said sighting pins each having a threaded portion and first and second nuts for selectively holding said sighting pins firmly within said slot.

3. A sighting attachment as claimed in claim 1 wherein said first nut is threaded onto said threaded portion of said sighting pin, said first nut having an externally threaded end portion, and said second nut is threaded to said threaded end portion of said first end.

4. A sighting attachment as claimed in claim 3 and further including a sight guard mounted to said front end portion and substantially surrounding said front bracket and said sighting pin.

5. A sighting attachment as claimed in claim 1 wherein said rear bracket has a top edge having a cutout portion therein, over which said sighting member is mounted.

* * * * *